United States Patent [19]

Frevert

[11] Patent Number: 4,498,981

[45] Date of Patent: Feb. 12, 1985

[54] VIBRATING ANTI-BLINDING CLEANING AND GRADING MACHINES

[75] Inventor: Robert E. Frevert, Saginaw, Mich.

[73] Assignee: Crippen Manufacturing Co., Inc., Alma, Mich.

[21] Appl. No.: 592,537

[22] Filed: Mar. 26, 1984

[51] Int. Cl.[3] ..... B07B 1/30; B07B 1/54; B07B 1/46

[52] U.S. Cl. ..... 209/243; 209/381; 209/405; 209/408; 209/414

[58] Field of Search ..... 209/381, 382, 404, 405, 209/408, 414, 329, 243; 55/300

[56] References Cited

U.S. PATENT DOCUMENTS

| | | | |
|---|---|---|---|
| 229,121 | 6/1880 | Hampee . | |
| 695,522 | 3/1902 | Wilkinson | 209/414 |
| 1,265,267 | 5/1918 | Simpson . | |
| 1,562,311 | 11/1925 | Dimm . | |
| 2,014,128 | 9/1935 | Deister | 209/382 |
| 2,226,416 | 12/1940 | Simpson | 209/382 |
| 2,332,780 | 11/1943 | Cecka | 209/323 |
| 2,395,138 | 2/1946 | Nicholls | 209/323 |
| 2,497,902 | 2/1950 | Moyer | 209/381 |
| 2,829,777 | 4/1958 | Landes et al. | 209/323 |
| 2,858,023 | 9/1958 | Holland | 209/381 |
| 2,908,391 | 9/1959 | Frevert | 209/315 |
| 2,946,440 | 7/1960 | Simpson | 209/326 |
| 3,022,893 | 2/1962 | Hasley | 209/404 |
| 3,565,251 | 2/1971 | Pennington | 209/405 |
| 4,122,006 | 11/1978 | Christensen et al. | 209/382 |

*Primary Examiner*—Frank W. Lutter
*Assistant Examiner*—Thomas M. Lithgow
*Attorney, Agent, or Firm*—Learman & McCulloch

[57] ABSTRACT

An anti-blinding grain, seed and like particulate cleaning and grading machine includes a gyrating support frame assembly, and mechanism for vibrating the assembly. Horizontally inclined opposed guide members extend along the side members of the assembly on the interior face thereof at a horizontally inclined angle to project interiorly thereof. The separating screen for separating overs and unders has side rails which are supported by the flanges which project outwardly from the side rails of a clearer ball tray to overlie the guide members. Balls trapped in the ball tray are deflected upwardly with the gyrating motion to engage the separating screen and keep it from becoming blinded. Swingable clamp shoes clamp the screen side rails and the ball tray side rails against the guide members.

4 Claims, 5 Drawing Figures

VIBRATING ANTI-BLINDING CLEANING AND GRADING MACHINES

BACKGROUND OF THE INVENTION

Various gyrating separating machines, incorporating usually a plurality of vertically spaced shoes for increased capacity purposes, and utilizing reciprocating brush assemblies to unclog blinded areas of the screens, have been successfully marketed and are in use in the field. Because a number of the users of such equipment find adjustment of the brushes to compensate for wear to be troublesome, the present inventor has provided a unique and novel construction for facilitating the replacement of brush assemblies, such as the type disclosed in his former U.S. Pat. No. 2,908,391, with rubber-ball clearers of the type shown, for example in the following patent Nos.:

229,121
1,265,267
1,562,311
2,226,416
2,332,780
2,395,138
2,497,902
2,829,772
2,858,023
2,946,440
3,565,251
4,122,006

SUMMARY OF THE INVENTION

One of the prime objects of the present invention is to provide a ball clearer conversion construction which utilizes components already in place in the field to the extent possible and provides a construction which adapts readily to existing installations in a manner such that screen changing can be easily effected without interference from the ball clearer assemblies.

Still another object of the invention is to provide an improved converted machine which is capable of performing grading and cleaning operations while automatically performing a screen clearing operation and without affecting the versatility of the operation, the conversion construction being such that the screens may be very rapidly interchanged by an operator in a minimum of time, so that the machine can handle diversified products without any appreciable down-time accumulating in changeover operations.

Another object of the invention is to provide a highly efficient and reliable changeover design which enables the changeover from brush to ball clearer assembly to be effected easily and economically in the field.

The improved construction utilizes horizontally inclined, opposed guide members, extending longitudinally along the shoe side members on the interior faces thereof, which project interiorly such that an enclosed ball frame, open at its upper end and with opposite horizontally inclined side rails spaced apart to be disposed inwardly of the guide members, can be supported by exteriorly projecting flanges from the guide members as to suspend the ball frame beneath a separator screen. Then the opposite side rails of the screen, which rest on said flanges, are clamped to the guide members, along with the flanges. Material supply equipment is provided for feeding the material to be graded to the upper end of the separating screen and for vibrating the whole assembly.

THE DETAILED CONSTRUCTION

Figure 1:
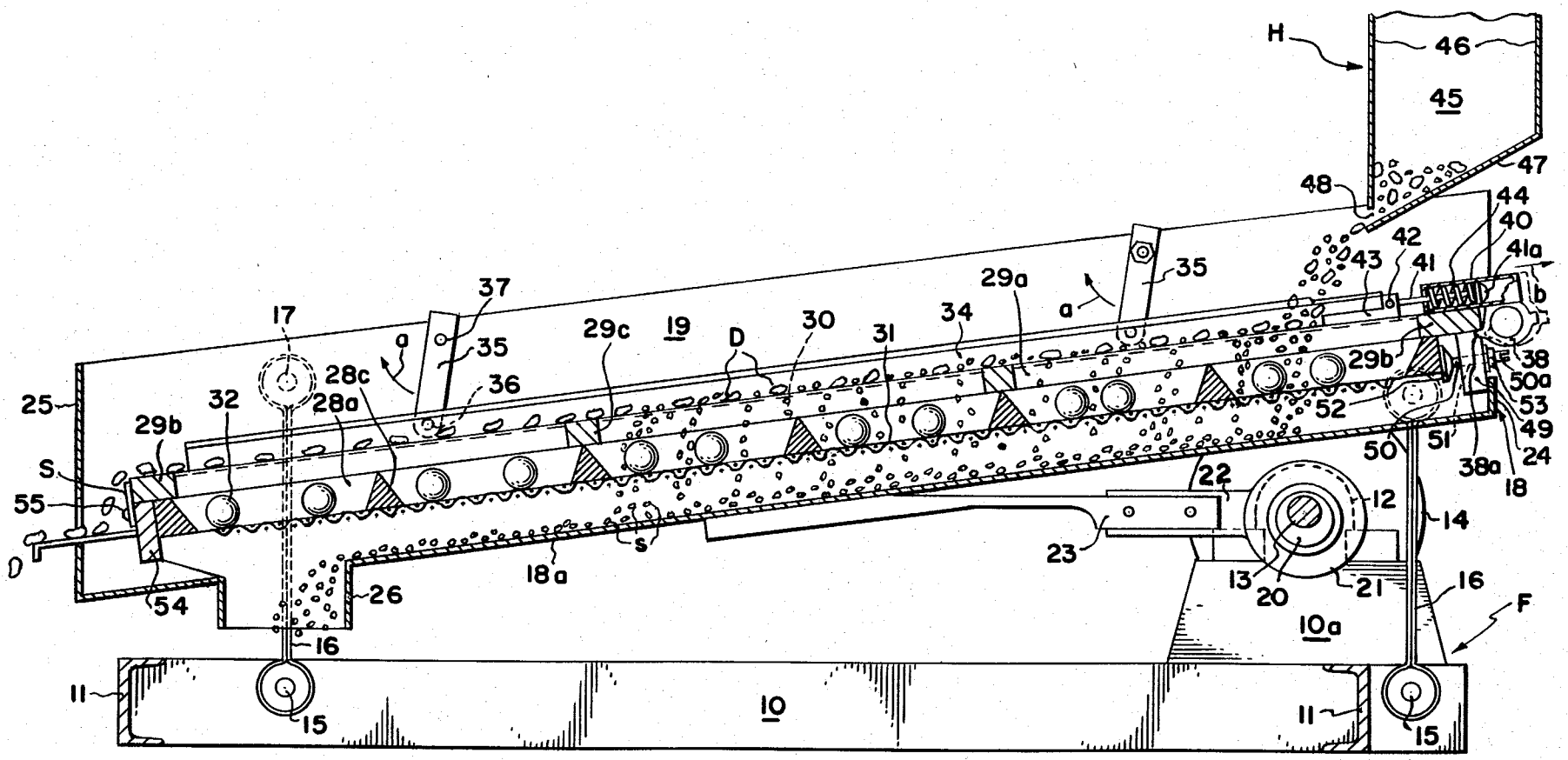
FIG. 1 is a sectional, side elevational view, taken on the line 1—1 of FIG. 2.

For purposes of convenience, a simple single shoe machine has been illustrated in the accompanying drawings; however, it is to be understood that the multiple shoe machine disclosed in former U.S. Pat. No. 2,908,391 can, as well, be converted to a machine of the design which has been claimed.

Referring now more particularly to the drawings, wherein I have shown a preferred embodiment of the invention only, a letter F generally indicates the stationary frame of my machine, which includes horizontal base sills or rails 10, connected by end rails 11. The sills 10 include box rails 10*a*, mounting bearings 12 for supporting a shaft 13 which is adapted to be driven from a suitable electric motor by a belt, or the like, trained around a drive sheave 14.

Also provided on sills 10, are fixed pins 15, supporting spring members 16 which connect, via fixed pins 17, to a shoe generally designated 18. The shoe has spaced apart, inclined side members 19. Eccentric members 20, provided on shafts 13, mount link rings 21 having projections 22 which are connected to the bottom pan 18*a* of shoe 18 by connecting arms 23 in a manner to effect continuous gyration of the shoe 18.

As will be observed from FIG. 1, the shoe 18 is longitudinally inclined and members 19 are connected by an end wall 24 at the upper end, and an end wall 25 at their lower end. Further provided at the lower end of the shoe 18, communicating with the imperforate pan 18*a*, is a discharge chute 26.

Figure 5:
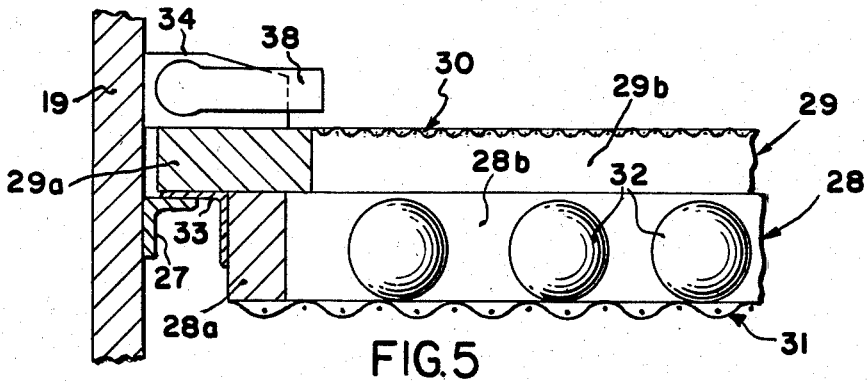
FIG. 5 is an enlarged, fragmentary, transverse, elevational view illustrating the manner in which the parts are clamped in a conversion unit.

Provided to extend longitudinally along the side members 18, are angle iron guide members 27 at each side of the machine, and as will later be more particularly described, these angle irons 27 can support both a clearer ball tray generally designated 28, and a separating screen 29 (FIG. 5).

Separator screen 29 includes frame side members 29*a* and frame end members 29*b*, which together with cross braces 29*c* support a foraminous separating screen 30. Ball and screen tray assembly 28 is made up of longitudinally extending side rails 28*a*, connected by end rails 28*b* and crosswise partitions 29*c*. A considerably coarser gauge perforate screen 31 forms the bottom of frame 28, and permits the passage of material through to the shoe floor 18*a*. The resilient rubber balls 32 provided in assembly 28 interact with the sloped surfaces of the end walls 28*b* and the partitions 28*c*, during the gyrating motion of the shoe 18, and are deflected up to engage screen 30 and keep it from becoming blinded.

It is to be observed that the side rails 28*a* of the ball and screen tray assembly 28 are more closely spaced together, than are the side rails 29*a* of the separating screen 29. Longitudinally extending flange members 33 are fixed to the side rails 28*a* to extend substantially the length thereof and project exteriorly sufficiently to overlie guides 27 provided on the shoe side members 19. As will be noted from FIG. 5, the members 33 perform the dual function of supporting the assembly 28 on guides 27, while at the same time providing surfaces for separating screen 29 to rest upon.

Figure 2:
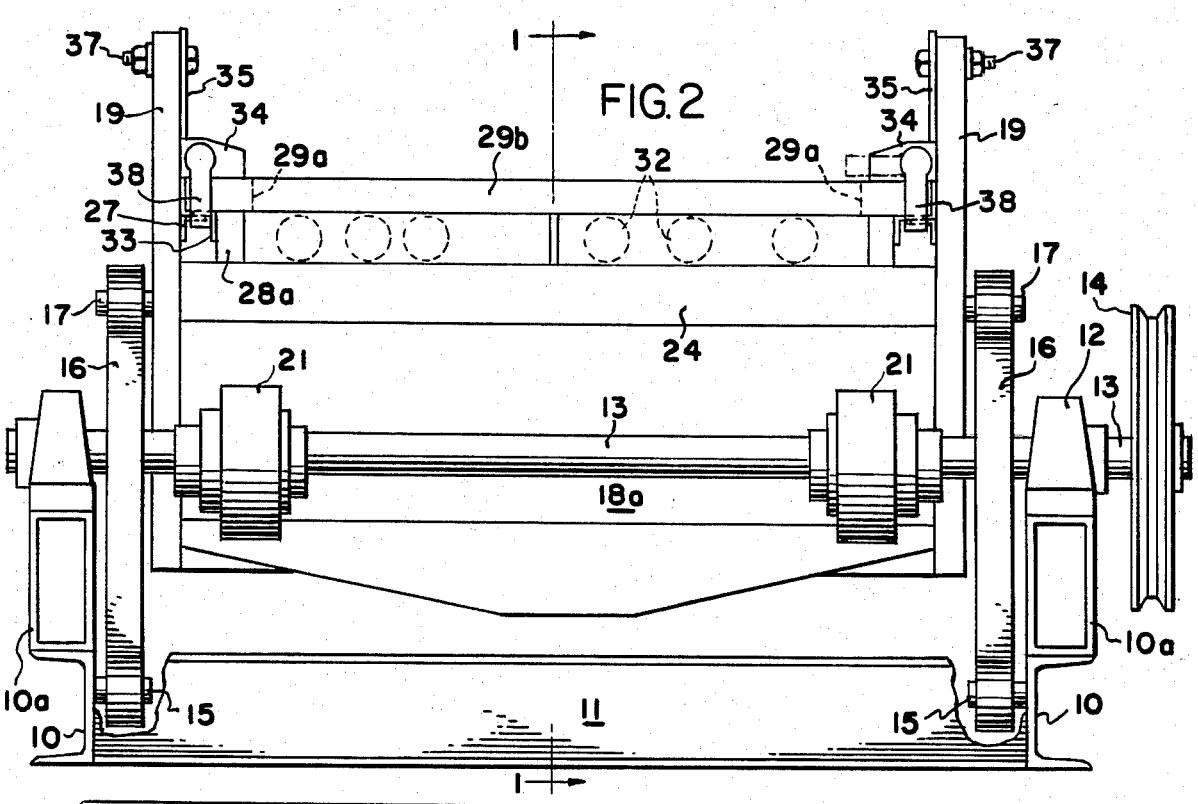
FIG. 2 is an end elevational view with the feed hopper omitted from the drawing for the sake of convenience.
Figure 3:
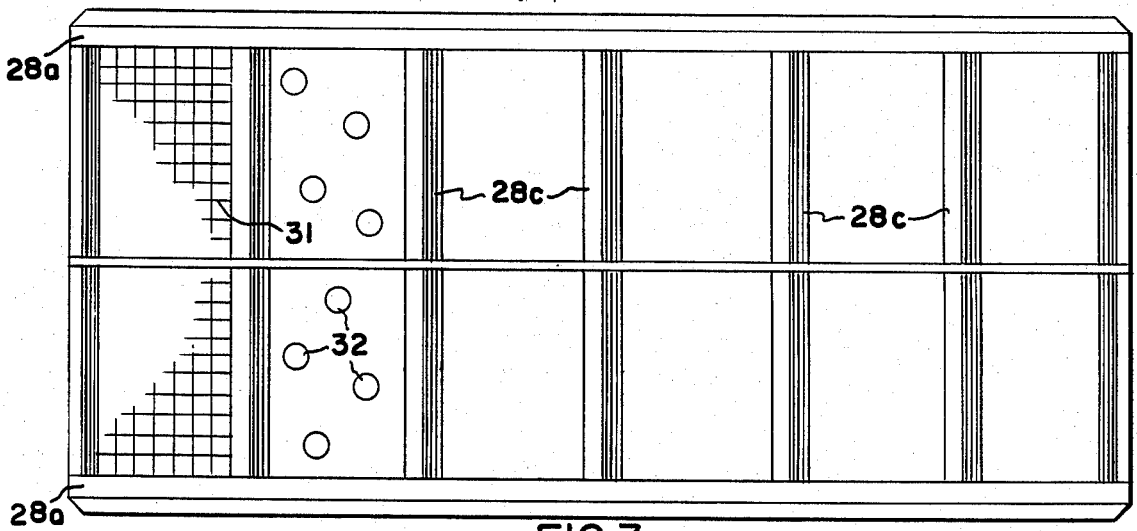
FIG. 3 is a top plan view of the clearer ball and screen assembly only.
Figure 4:
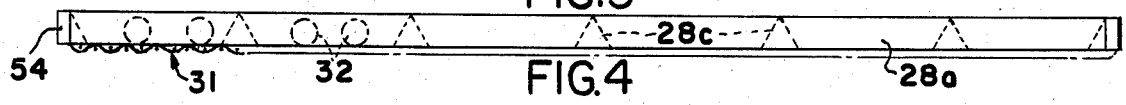
FIG. 4 is a longitudinal elevational view thereof.

Provided directly above the guides 27 which extend from one end of the shoe 18 to the other (FIGS. 1, 2 and 5) are spaced apart clamp rail members 34 which extend generally parallel to the rails 29*a* and 28*a* and are provided to exert a vertical clamping pressure to clamp the side rails 29*a* and the flange members 33 securely against the longitudinally extending guides 27 at each side. The clamp rails 34 are supported by arms 35 which are connected by pins 36. It is to be understood that the arms 35 are pivotally connected to the shoe side members 19 by pins 37, such that arms 35 can be pivoted in the direction indicated by arrow a to a raised position above screen 29. When the arms 35 are pivoted back to engage the rails 34 with the screen side rails 29*a*, pistol-grip type screen clamps may be employed to clamp the elements in position.

FIG. 1 discloses such a ring clamp member 38 which has a projection 38*a* for hooking under the lower edge of the upper screen end rail 29*b*. Clamp members 38 are provided at the upper end of each clamp rail 34. Fixed to each member 38 is a rotatable spring housing 40, carrying a plunger 41 connected by a pin 42 to a bracket 43, carried by the clamp rail 34. A spring 44, disposed between the end of the housing 40 and the head 41*a* of the plunger, normally tends to retain the clamp lug 38*a* in the locked position.

Mounted above the machine is the usual hopper, generally designated H, which includes side walls 45, end walls 46, and a bottom wall 47, inclined to create an opening 48 which meters the flow of material from the hopper H to the upper end of the separating screen 29.

At its upper end, assembly or shoe 18 is provided with a cross piece 49, which is fixed in stationary position. An adjustment screw 50 at each side of the machine, is threaded through an opening 51 provided in the member 49 at each side and each screw 50 has an enlarged head 52 for engaging the ball tray 28. Each screw 50 may be provided with a screw driver slot 50*a*, and a lock nut 53 is also preferably employed with each screw 50.

THE OPERATION

The flow of material from hopper H is gradually separated by the screen 30 which gyrates back and forth continuously with shoe 18. In the seed cleaning operation depicted, the smaller seeds s fall down through the screen 30 and the considerably coarser mesh screen 31 to the pan 18*a* and chute 26 which can discharge to a suitable conveyor (not shown).

The larger debris, such as trash and chaff, generally indicated D, feeds off the lower end of the screen 30 as indicated in FIG. 1, to a separate discharge conveyor. Of course, it is not at all necessary that the "good" material be delivered through the screens 30 and 31. In some operations, where "fine" material is to be removed from grains, it is the "fine" material which is sifted out by the gyrating assembly and proceeds through to the discharge chute 26.

Now, assuming the machine is in the assembled condition shown in FIG. 1, and it is desired to change to a finer or coarser screening operation, it is merely necessary to insert the fingers through and pull each ring clamp 38 outwardly to the broken line position shown in FIG. 1 to unhook it, and then to swing it upwardly 90° (about the housing 40 as a pivot shaft) to clear the rail 29*b*. Each clamp 38 used will be similarly unhooked and rotated, and then the clamps 38 will be pushed forwardly to swing arms 35 upwardly in the direction a, until an inch or so of clearance is provided between the clamp rails 34 and the screen side rails 29*a*. At this point, the screen 29 can simply be pulled upwardly along guides 27 to remove it, and a new screen inserted until its lower end rail 29*b* is engaged with the screen stop S which bridges the two side rails 19. The position of ball tray 28 is also fixed by the clamp 52 which clamps the ball tray against the stop 54, which is secured to stop S as at 55. To return the clamps 38 to the position shown in FIG. 1, is a simple matter—it merely being necessary to pull them outwardly in the direction of the arrow b in FIG. 1, which restores arms 35 to the position shown, and permits each ring 38 to be rotated back to hook its projection 38*a* under the screen once again.

Generally speaking, it has been found that an approximately three-quarter inch clearance is appropriate between the top of the balls in the rest position, and the screen 30, when $1\frac{3}{8}''$ diameter balls are used.

Because the projecting flanges 29*a* are relatively thin and extend laterally from the upper surfaces of rails 28*a*, they do not add appreciably to the vertical distance between the guides 27 and swingable clamp shoes 34. Accordingly, machines in the field can be converted by simply removing the brushes and inserting the ball tray, without need for any adjustment of the existing clamp shoes 34.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

What is claimed is:

1. Improvements in gyrating anti-blinding grain, seed, and like particulate, cleaning and/or grading machines comprising, in combination:

a. a vertically open perimetral support frame assembly having opposite side members with upper and lower ends;

b. means mounting said assembly for vibratory movement;

c. means for vibrating said assembly;

d. laterally spaced apart horizontally inclined opposed guide members extending along said side members on the interior face thereof to project interiorly thereof, and having upper and lower ends;

e. an enclosed planar ball tray, open at its upper face, and having opposite, horizontally inclined side rails with upper and lower ends spaced apart to be disposed laterally inwardly of said guide members, the ball tray being closed at its bottom by a screen and crosswise partitions connecting the side rails, and there being a series of resilient balls retained within the frame over the length thereof by said lower screen and partitions;

f. relatively reduced thickness flanges fixed on said side rails of the ball tray projecting laterally outwardly from the upper edges thereof to overlie said guide members and be supported thereon;

g. a planar separating screen for separating overs and unders comprising a perforate body spanning opposite side rails which are spaced apart further than said side rails of the ball tray side rails such as to rest on said flanges;

h. clamp means on said assembly exerting a vertical pressure on said screen side rails along their lengths to clamp said screen side rails and ball tray side rails against said guide members; and i. means for feeding material to be graded to the upper end of the separating screen.

2. The machine of claim 1 wherein upper and lower end rails connect the side rails of said ball tray at opposite ends thereof; end members are provided for the support assembly at opposite ends thereof; and adjustable clamp means extends from the upper end member of the support frame assembly in the plane of the ball tray to engage the upper end rail of the ball tray and exert a clamping pressure urging it into clamped engagement against the lower end member of the support frame assembly.

3. The machine of claim 2 wherein said adjustable clamp means comprises screw and lock nut means.

4. Improvements in the conversion of gyrating anti-blinding grain, seed, and like particulate, cleaning and/or grading machines which comprise a vertically open perimetral support frame assembly having opposite side members with upper and lower ends; means mounting said assembly for vibratory movement; means for vibrating said assembly; laterally spaced apart horizontally inclined opposed guide members extending along said side members on the interior face thereof to project interiorly thereof, and having upper and lower ends; a planar separating screen for separating overs and unders comprising opposite side rails and a perforate body spanning said opposite side rails which are spaced apart such as to overlie said guide members; and clamp shoes swingably mounted above said screen side rails; comprising the steps of:

a. mounting relatively reduced thickness flanges on the side rails of an enclosed planar ball tray having opposite, horizontally inclined side rails with upper and lower ends spaced apart to be disposed laterally inwardly of said guide membes, the ball tray being open at its top and closed at its bottom by a screen and crosswise partitions connecting the side rails, and there being a series of resilient balls retained within the frame over the length thereof by said lower screen and partitions, the flanges projecting laterally outwardly from the upper edges thereof to overlie said guide members;

b. removing said screen and slipping said ball tray endwisely along said guide members such that said flanges can support the side rails of said screen;

c. and replacing said screen and swinging said clamp shoes down to exert a vertical pressure on said screen side rails along their lengths to clamp said ball tray flanges against said guide members.

* * * * *